US011286647B2

(12) United States Patent
Kim et al.

(10) Patent No.: US 11,286,647 B2
(45) Date of Patent: Mar. 29, 2022

(54) ELECTROHYDRAULIC CONTROL DEVICE FOR CONSTRUCTION MACHINE AND METHOD THEREOF

(71) Applicant: Doosan Infracore Co., Ltd., Incheon (KR)

(72) Inventors: Taeyoon Kim, Seoul (KR); Gyebong Jang, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/980,240

(22) PCT Filed: Feb. 22, 2019

(86) PCT No.: PCT/KR2019/002183

§ 371 (c)(1),
(2) Date: Sep. 11, 2020

(87) PCT Pub. No.: WO2019/177279

PCT Pub. Date: Sep. 19, 2019

(65) Prior Publication Data

US 2021/0032851 A1 Feb. 4, 2021

(30) Foreign Application Priority Data

Mar. 12, 2018 (KR) ..... 10-2018-0028650

(51) Int. Cl.
*F15B 13/043* (2006.01)
*E02F 9/22* (2006.01)
*F15B 13/02* (2006.01)

(52) U.S. Cl.
CPC ..... *E02F 9/2267* (2013.01); *E02F 9/2296* (2013.01); *F15B 13/0433* (2013.01);
(Continued)

(58) Field of Classification Search
None
See application file for complete search history.

(56) References Cited

U.S. PATENT DOCUMENTS 10,590,963 B2 * 3/2020 Kondo ..... F15B 11/10
10,849,577 B2 * 12/2020 Okumura ..... A61B 6/025
(Continued)

FOREIGN PATENT DOCUMENTS

DE 102015122929 A1 * 6/2017 ..... F15B 13/0422
JP 2000265498 A 9/2000
(Continued)

OTHER PUBLICATIONS

International Search Report for related International Application No. PCT/KR2019/002183; report dated Sep. 19, 2019; (5 pages).
(Continued)

*Primary Examiner* — Michael Leslie
(74) *Attorney, Agent, or Firm* — K&L Gates LLP

(57) ABSTRACT

An electro-hydraulic control apparatus for construction machinery includes a control valve installed in a hydraulic line between a hydraulic pump and an actuator to control operations of the actuator according to a displacement amount of a spool therein, a spool displacement adjusting valve configured to output a secondary pressure in proportion to an inputted pressure command signal to the spool of the control valve to control the displacement amount of the spool of the control valve, a pressure sensor to detect the secondary pressure outputted from the spool displacement adjusting valve, and a controller configured to output the pressure command signal to the spool displacement adjusting valve according to a manipulation signal of the construction machinery, and to correct the pressure command signal when a pressure difference between the detected secondary pressure and a design pressure predetermined by
(Continued)

the pressure command signal is out of a preset allowable range.

15 Claims, 4 Drawing Sheets

(52) U.S. Cl.
CPC ..... *E02F 9/2235* (2013.01); *F15B 13/025* (2013.01); *F15B 2211/355* (2013.01); *F15B 2211/36* (2013.01); *F15B 2211/6316* (2013.01); *F15B 2211/6346* (2013.01); *F15B 2211/6355* (2013.01); *F15B 2211/67* (2013.01)

(56) References Cited

U.S. PATENT DOCUMENTS

| | | | | |
|---|---|---|---|---|
| 10,920,394 | B2 * | 2/2021 | Kobayashi | E02F 3/435 |
| 2019/0257328 | A1 * | 8/2019 | Erikksson | F15B 20/004 |
| 2021/0207345 | A1 * | 7/2021 | Kobayashi | E02F 9/2292 |

FOREIGN PATENT DOCUMENTS

| | | | |
|---|---|---|---|
| JP | 2015166516 | A | 9/2015 |
| JP | 2016142285 | A | 8/2016 |
| KR | 20100024737 | A | 3/2010 |
| KR | 20160087539 | A | 7/2016 |

OTHER PUBLICATIONS

Written Opinion for related International Application No. PCT/KR2019/002183; report dated Sep. 19, 2019; (5 pages).

* cited by examiner

ELECTROHYDRAULIC CONTROL DEVICE FOR CONSTRUCTION MACHINE AND METHOD THEREOF

CROSS-REFERENCE TO RELATED APPLICATIONS

The present application is a National Stage of International Application No. PCT/KR2019/002183, filed Feb. 22, 2019 which claims priority to Korean Application No. 10-2018-0028650, filed Mar. 12, 2018, the disclosure of which is incorporated herein by reference.

TECHNICAL FIELD

The present disclosure relates to an electro-hydraulic control apparatus and method for construction machinery. More particularly, the present disclosure relates to an electro control apparatus and method for construction machinery including an electro-hydraulic main control valve using an electro proportional pressure reducing valve.

SUMMARY

In construction machinery, an electro-hydraulic main control valve with an electro proportional pressure reducing valve (EPPRV) may be used. Accordingly, compared to a conventional hydraulic main control valve, risks due to a failure of the electro proportional pressure reducing valve may be further increased, and countermeasures in case of failures may be becoming more important.

As the use period of the electro proportional pressure reducing valve elapses, a secondary pressure of the electronic proportional pressure reducing valve may be generated smaller or larger than an external pressure command signal. In this case, there is a problem in that a pump pressure exhibits an operating pressure different from the design specifications, thereby deteriorating the performance of the construction machine.

An object of the present disclosure provides an electro-hydraulic control apparatus for construction machinery capable of maintaining reliable performances.

Another object of the present disclosure provides an electro-hydraulic control method for construction machinery using the above control apparatus.

According to example embodiments, an electro-hydraulic control apparatus for construction machinery includes a control valve installed in a hydraulic line between a hydraulic pump and an actuator to control operations of the actuator according to a displacement amount of a spool therein, a spool displacement adjusting valve configured to output a secondary pressure in proportion to an inputted pressure command signal to the spool of the control valve to control the displacement amount of the spool of the control valve, a pressure sensor to detect the secondary pressure outputted from the spool displacement adjusting valve, and a controller configured to output the pressure command signal to the spool displacement adjusting valve according to a manipulation signal of the construction machinery, and to correct the pressure command signal when a pressure difference between the detected secondary pressure and a design pressure predetermined by the pressure command signal is out of a preset allowable range.

In example embodiments, when the pressure difference is out of the preset allowable range, the controller may correct the pressure command signal using a characteristic function of the pressure command signal of the spool displacement control valve versus the design pressure.

In example embodiments, the controller may calculate a correction value of the pressure command signal by reflecting a difference value of the pressure command signal which converts the detected secondary pressure into the design pressure according to the characteristic function.

In example embodiments, the controller may output a correction value of the pressure command signal as a new pressure command signal to the spool displacement adjusting valve.

In example embodiments, the controller may detect a new secondary pressure outputted from the spool displacement adjusting valve according to the correction value of the pressure command signal, and when a pressure difference between the new secondary pressure and the design pressure is out of the preset allowable range, the controller may correct the correction value of the pressure command difference using the characteristic function.

In example embodiments, the controller may include a storage portion configured to store data of a characteristic function of the pressure command signal of the spool displacement control valve versus the design pressure, a comparison portion configured to compare the detected secondary pressure and the design pressure and correct the pressure command signal using the characteristic function data, and an output portion configured to output a correction value of the pressure command signal as a new pressure command signal to the spool displacement adjusting valve.

In example embodiments, the storage portion may store the correction value of the pressure command signal as a new pressure command signal for the design pressure.

In example embodiments, the spool displacement adjusting valve may include an electro proportional pressure reducing valve (EPPRV).

According to example embodiments, in an electro-hydraulic control method for construction machinery, an electro-hydraulic control apparatus of the construction machinery including a control valve installed in a hydraulic line between a hydraulic pump and an actuator to control operations of the actuator according to a displacement amount of a spool therein, and a spool displacement adjusting valve configured to output a secondary pressure in proportion to an inputted pressure command signal to the spool of the control valve to control the displacement amount of the spool of the control valve, the secondary pressure outputted from the spool displacement adjusting valve is detected. The pressure command signal is corrected when a pressure difference between the detected secondary pressure and a design pressure predetermined by the pressure command signal is out of a preset allowable range. A correction value of the pressure command signal is stored as a new pressure command signal for the design pressure.

In example embodiments, correcting the pressure command signal may include using a characteristic function of the pressure command signal of the spool displacement control valve versus the design pressure.

In example embodiments, correcting the pressure command signal may include calculating the correction value of the pressure command signal by reflecting a difference value of the pressure command signal which converts the detected secondary pressure into the design pressure according to the characteristic function.

In example embodiments, the electro-hydraulic control method for construction machinery may further include detecting a new secondary pressure outputted from the spool displacement adjusting valve according to the correction value of the pressure command signal, and correcting the correction value of the pressure command difference using the characteristic function when a pressure difference between the new secondary pressure and the design pressure is out of the preset allowable range.

In example embodiments, the electro-hydraulic control method for construction machinery may further include outputting the correction value of the pressure command signal as a new pressure command signal to the spool displacement adjusting valve.

According to example embodiments, in an electro-hydraulic control apparatus and method for construction machinery, when a pressure difference between a secondary pressure (pilot signal pressure) outputted from a spool displacement adjusting valve and a design pressure predetermined by a pressure command signal is out of a preset allowable range, the pressure command signal may be corrected.

Accordingly, even if the secondary pressure outputted from the spool displacement adjusting valve changes as the usage period elapses, the correction program may be performed to thereby continuously maintain reliable performances of the construction machine.

However, the effect of the disclosure may not be limited thereto, and may be expanded without being deviated from the concept and the scope of the present disclosure.

DETAILED DESCRIPTION

Figure 1:
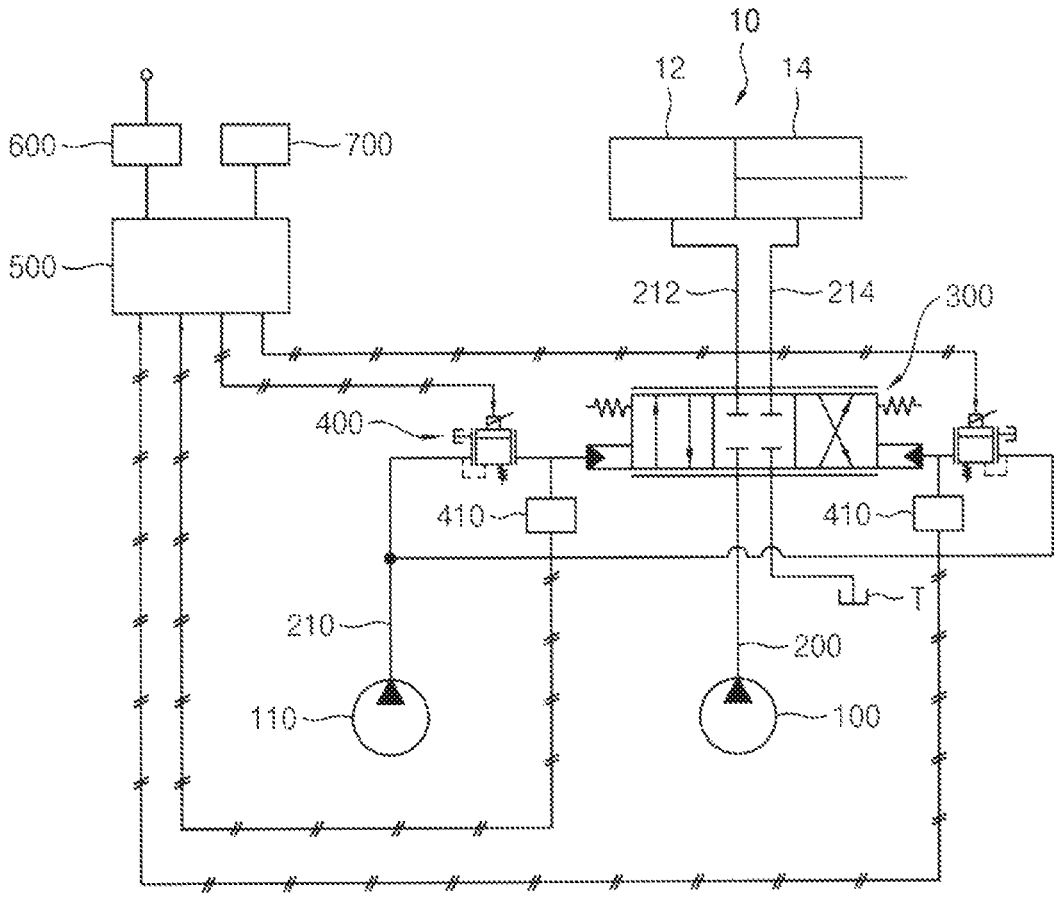
FIG. 1 is a hydraulic circuit diagram illustrating an electro-hydraulic control system for construction machinery in accordance with example embodiments.

Hereinafter, preferable embodiments of the present disclosure will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
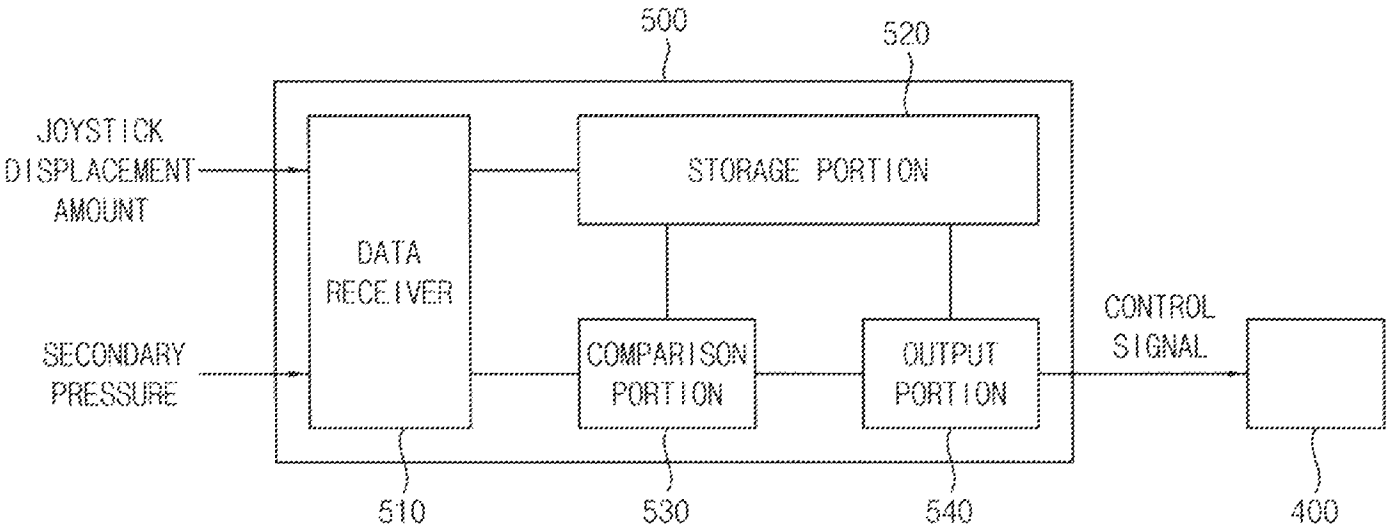
FIG. 2 is a block diagram illustrating a controller of the electro-hydraulic control system for construction machinery in FIG. 1.

FIG. 1 is a hydraulic circuit diagram illustrating an electro-hydraulic control system for construction machinery in accordance with example embodiments. FIG. 2 is a block diagram illustrating a controller of the electro-hydraulic control system for construction machinery in FIG. 1.

Referring to FIGS. 1 and 2, an electro-hydraulic control system for construction machinery may include a hydraulic pump 100, a pilot pump 110, at least one control valve installed in a hydraulic line 200 between the hydraulic pump 100 and at least one actuator 10 to control operations of the actuator 10, at least one spool displacement adjusting valve 400 outputting a pilot working oil from the pilot pump 110 to a spool of the control valve 300 to have a secondary pressure proportional to an inputted pressure command signal, a pressure sensor to detect the secondary pressure outputted from the spool displacement adjusting valve 400, and a controller configured to output the pressure command signal to the spool displacement adjusting valve 400 according to a manipulation signal of the construction machinery to control operations of the actuator 10.

For example, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. As the boom cylinder, the arm cylinder and the bucket cylinder expand or contract, the boom, the arm and the bucket may implement various movements, to thereby perform various works.

In example embodiments, the hydraulic pump 100 may be connected to an engine (not illustrated) through a power transmission device such that a power of the engine may be transferred to the hydraulic pump 100. A working oil discharged from the hydraulic pump 100 may be supplied to the actuator 10 through the control valve 300.

The control valve may be connected to the hydraulic pump 100 through the hydraulic line 200. As the control valve 300 is switched, the working oil discharged from the hydraulic pump 100 may be supplied to the actuator 10 through the control valve 300.

For example, the actuator 10 may be the bucket cylinder, and the control valve 300 may be a bucket control valve. Alternatively, the actuator may be the boom cylinder or the arm cylinder, and the control valve may be a boom control valve or an arm control valve.

The control valve 300, that is, the bucket control valve may be connected to the actuator 10, that is, a bucket head chamber 12 and a bucket rod chamber 14 of the bucket cylinder through a bucket head hydraulic line 212 and a bucket rod hydraulic line 214, respectively. Accordingly, the control valve 300 may be switched to selectively supply the working oil discharged from the hydraulic pump 100 to the bucket head chamber 12 and the bucket rod chamber 14.

The working oil which drives the bucket cylinder 10 may return to a drain tank T through a return hydraulic line. For example, during a bucket crowd operation the working oil from the bucket rod chamber 14 may return to the drain tank T via the control valve 300, that is, the bucket control valve through the bucket rod hydraulic line 214.

The pilot pump 110 may be connected to the engine, and a power of the engine may be transferred to the pilot pump 110. The pilot pump 110 may discharge the pilot working oil through a plot line 210, and the discharged pilot working oil may be supplied to the spool displacement adjusting valve 400. For example, the pilot pump 100 may include a gear pump.

The pilot working oil discharged from the pilot pump 110 may be supplied to the spool of the control valve 300 through the spool displacement adjusting valve 400. The pilot working oil discharged from the pilot pump 110 may be supplied to the spool displacement adjusting valve 400 through the pilot line 210. The spool displacement adjusting valve 400 may supply the pilot signal pressure in proportion to the inputted control signal (pressure command signal) to the spool of the control valve 300 to control a displacement of the spool of the control valve 300.

For example, a pair of the spool displacement adjusting valves 400 may be provided in both sides of the spool of the control valve 300. The pilot signal pressure outputted from the spool displacement adjusting valve 400 may be supplied selectively to both sides of the spool, to switch the control valve 320. The spool displacement adjusting valve 400 may supply the secondary pressure (pilot signal pressure) having a magnitude proportional to the inputted control signal (pressure command signal). The movement of the spool of the control valve 300 may be controlled by the pilot signal pressure. That is, the movement direction of the spool may be determined by a supply direction of the pilot signal pressure, and the displacement amount of the spool may be determined by the magnitude of the pilot signal pressure.

In example embodiments, the electro-hydraulic control system for construction machinery may include an electro-hydraulic main control valve (MCV) as an assembly including the at least one control valve. The spool displacement adjusting valve 400 may include an electro proportional pressure reducing valve (EPPRV). The spool displacement adjusting valve 400 may control a pressure of the pilot working oil (secondary pressure) supplied to the spool of the control valve according to an inputted electrical signal (pressure command signal).

In example embodiments, the controller 500 may receive the manipulation signal in proportion to a manipulation amount of an operator from a manipulation portion 600, and may output a pressure command signal as the control signal to the spool displacement adjusting valve 400 corresponding to the manipulation signal. The electro proportional pressure reducing valve may output a secondary pressure in proportion to the pressure command signal to the corresponding spool, to control the spool using electrical signals.

In particular, the controller 500 may receive a manipulation signal for the actuator 10, for example, a joystick displacement amount, and generate and apply a control signal corresponding to the joystick displacement amount, for example, pressure command current signal (mA) to the spool displacement adjusting valve. The spool displacement adjusting valve may supply a pilot signal pressure in proportion to the applied current (mA) to the spool of the control valve 300 to move the spool of the control valve 300 according to the supplied pilot signal pressure. Accordingly, the joystick displacement amount for the first actuator 10 may be converted into a spool displacement amount of the control valve 310 at a predetermined conversion ratio.

For example, the manipulation portion 600 may include a joystick, a pedal, etc. When an operator manipulates the manipulation portion 600, a manipulation signal corresponding to the manipulation may be generated. The manipulation portion 600 may include a sensor for detecting the joystick displacement amount (or angle). The manipulation portion 600 may output a signal such as a voltage signal or a current signal corresponding to the detected displacement amount. The controller 500 may receive the manipulation signal and control the main control valve corresponding to the manipulation signal, to operate the actuator.

In example embodiments, when the secondary pressure detected by the pressure sensor 410 is out of an allowable range of a design pressure predetermined by the pressure command signal, the controller 500 may correct the pressure command signal and output the corrected pressure command signal to the spool displacement adjusting valve 400.

The spool displacement adjusting valve 400 may supply a pilot signal pressure (secondary pressure) in proportion to a pressure command signal (mA) applied from the controller 500, to the spool of the control valve 300. The pressure command signal and the secondary pressure may be parameters determined by a unique characteristic function of a pressure command signal of the spool displacement control valve 400 versus a design pressure.

As the usage period elapses, the secondary pressure (pilot signal pressure) outputted from the spool displacement adjusting valve 400 may change, and thus the secondary pressure may be out of an allowable error range of a desired requirement pressure (design pressure). In this case, the controller 500 may perform a correction program for correcting the pressure command signal to be outputted to the spool displacement adjusting valve 400 such that the spool displacement adjusting valve 400 may output a secondary pressure within the allowable error range of the desired requirement pressure.

In example embodiments, the electro-hydraulic control system for construction machinery may further include a selection portion for determining whether to perform the correction program of the spool displacement adjusting valve 400. An operator may determine whether to perform the correction program through the selection portion 700, and the controller 500 may perform the correction program of the spool displacement adjusting valve 400 according to an execution control signal of the correction program from the selection portion 700.

As illustrated in FIG. 2, the controller 500 may include a data receiver 510, a storage portion 520, a comparison portion 530 and an output portion 540.

The data receiver 510 may receive a joystick displacement amount from the manipulation portion 600, an execution control signal of the correction program from the selection portion 700, and a secondary pressure outputted from the spool displacement adjusting valve 400 from the pressure sensor 410. The data receiver 510 may receive the joystick displacement amounts as the manipulation signals for the boom, the arm, the bucket and a swing motor. For example, the data receiver 510 may receive a bucket joystick displacement amount as the manipulation signal for the bucket.

The storage portion 520 may store data of the characteristic function of the pressure command signal of the spool displacement control valve 400 versus the design pressure. For example, the storage portion 520 may store initial data for the characteristic function of the spool displacement adjusting valve 400. Table 1 below shows the parameters (pressure command signal versus design pressure) of the spool displacement adjusting valve stored at initialization execution.

TABLE 1

| pressure command signal reference value (mA) | secondary pressure reference value (bar) |
|---|---|
| . . . | . . . |
| 337 mA | 7 bar |
| 445 mA | 14 bar |
| 596 mA | 24 bar |
| . . . | . . . |
| . . . | . . . |

Additionally, the storage portion 520 may store a correction value of the pressure command signal calculated by the comparison portion 530 as described below, as a new pressure command signal for the design pressure (secondary pressure reference value).

The comparison portion 530 may compare the detected secondary pressure and the design pressure predetermined by the pressure command signal and may correct the pressure command signal using the characteristic function data. The comparison portion 530 may correct the pressure command signal using the characteristic function of the pressure command signal of the spool displacement control valve 400 versus the design pressure.

For example, a characteristic function in a section between the design pressure and the detected secondary pressure may be determined, and a correction value of the pressure command signal may be calculated by reflecting a difference value of the pressure command signal which converts the detected secondary pressure into the design pressure according to the characteristic function in the section.

Additionally, a new secondary pressure outputted from the spool displacement control valve 400 according to the correction value of the pressure command signal may be detected, and when a pressure difference between the new secondary pressure and the design pressure is out of a preset allowable range, the calculated correction value of the pressure command signal may be corrected using the characteristic function.

The output portion 540 may output the correction value of the pressure command signal as a new pressure command signal to the spool displacement adjusting valve 400.

Hereinafter, correction processes of the pressure command signal performed according to the correction program will be explained.

Figure 3:
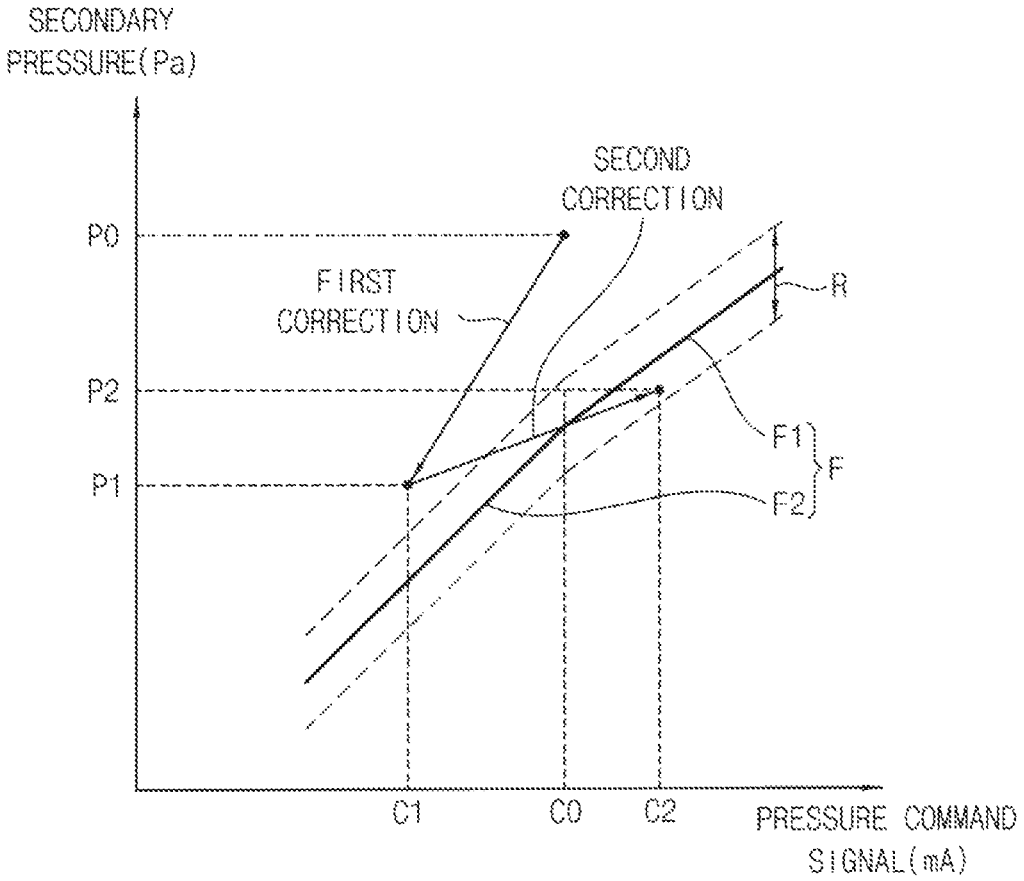
FIG. 3 is a graph illustrating correction processes of a pressure command signal performed by the controller in FIG. 1.

FIG. 3 is a graph illustrating correction processes of a pressure command signal performed by the controller in FIG. 1.

Table 2 below shows correction processes of a pressure command signal with respect to a design pressure of 14 bar.

TABLE 2

| | first comparison | first correction | second comparison | second correction | third comparison |
|---|---|---|---|---|---|
| secondary pressure reference value | 14 bar | — | 14 bar | — | 14 bar |
| pressure command signal (mA) | 445 mA | 422.35 mA | — | 457.32 mA | — |
| secondary pressure detected value | 15.5 bar | — | 13.2 bar | — | 14.2 bar |

Referring to FIG. 3 and Table 2, when the controller 500 receives the execution control signal of the correction program, the controller 500 may output an initial pressure command signal C0 (445 mA) stored as an initialization execution value to the spool displacement adjustment valve 400. Then, the controller 500 may compare a secondary pressure P0 (15.5 bar) outputted from the spool displacement amount adjusting valve 400 and detected by the pressure sensor 410 and a design pressure (14 bar) predetermined with respect to the initial pressure command signal C0, and may calculate a correction value C1 of the pressure command signal using the characteristic function when a pressure difference is out of the preset allowable range.

The correction value of the pressure command signal may be calculated by reflecting a difference value of the pressure command signal which converts the detected secondary pressure P0 into the design pressure (14 bar) according to the characteristic function. A characteristic function F of the spool displacement adjusting valve 400 in a section between 14 bar and 24 bar may be determine, and the correction value of the pressure command signal may be calculated using a linear interpolation method in the section. For example, in the section F1 between 14 bar and 24 bar, a conversion ratio may be 15.1 mA/bar ((596−445)/10 mA/bar), and thus the difference value (1.5 bar*15.1 mA/bar) of the pressure command signal which converts the detected secondary pressure into the design pressure may be reflected to calculate a new pressure command signal (422.35 mA (445 mA−(1.5 bar*15.1 mA/bar))).

Then, a secondary pressure P1 (13.2 bar) outputted from the spool displacement adjusting valve 400 according to the correction value C1 of the pressure command signal may be compared with the design pressure (14.2 bar) predetermined by the initial pressure command signal C0, and when a pressure difference between the secondary pressure and the design pressure is out of a preset allowable range (R), a correction value C2 of the corrected pressure command signal may be calculated using the characteristic function.

The correction value of the corrected pressure command signal may be calculated by reflecting a difference value of the pressure command signal which converts the detected secondary pressure P1 into the design pressure (14 bar) according to the characteristic function. A characteristic function F2 in a section between 7 bar and 14 bar may be determined from the data of the characteristic function of the spool displacement adjusting valve 400, and the correction value of the pressure command signal may be calculated using a linear interpolation method in the section. For example, in the section between 7 bar and 14 bar, a conversion ratio may be 15.4 mA/bar ((445−337)/10 mA/bar), and thus the difference value (0.8 bar*15.4 mA/bar) of the pressure command signal which converts the detected secondary pressure into the design pressure may be reflected to calculate a new pressure command signal (457.32 mA (445 mA−(0.8 bar*15.4 mA/bar))).

Then, a secondary pressure P2 (14.2 bar) outputted from the spool displacement adjusting valve 400 according to the correction value C2 of the pressure command signal may be compared with the design pressure (14.2 bar) predetermined by the initial pressure command signal C0, and when a pressure difference between the secondary pressure and the design pressure is within the preset allowable range (R) (for example, 1 bar), the correction program may terminate. In here, the correction value C2 of the pressure command signal calculated by the comparison portion 530 may be stored a new pressure command signal reference valve for the design pressure (14 bar), and the output portion 540 may output the newly stored correction value C2 of the pressure command signal as a pressure command signal for the design pressure (14 bar) to the spool displacement adjusting valve 400.

Additionally, the controller 500 may perform a correction process of a pressure command signal for another sampled design pressure. The controller 500 may execute initialization when the pressure difference is out of the preset allowable range even after performing correction for a preset number of times or more, output the initial pressure command signal stored as the initialization execution value to the spool displacement adjustment valve 400, and correct the pressure command signal using an adjusted characteristic function of the spool displacement adjusting valve.

As mentioned above, the electro-hydraulic control apparatus for construction machinery may correct the pressure command signal when the pressure difference between the secondary pressure outputted from the spool displacement adjusting valve and the design pressure predetermined by the pressure command signal is out of a preset allowable range.

Accordingly, even if the secondary pressure (pilot signal pressure) outputted from the EPPR valve changes as the usage period elapses, the correction program may be performed to thereby continuously maintain reliable performances of the construction machine.

Hereinafter, a control method for construction machinery using the electro-hydraulic control apparatus in FIGS. 1 and 2 will be explained.

Figure 4:
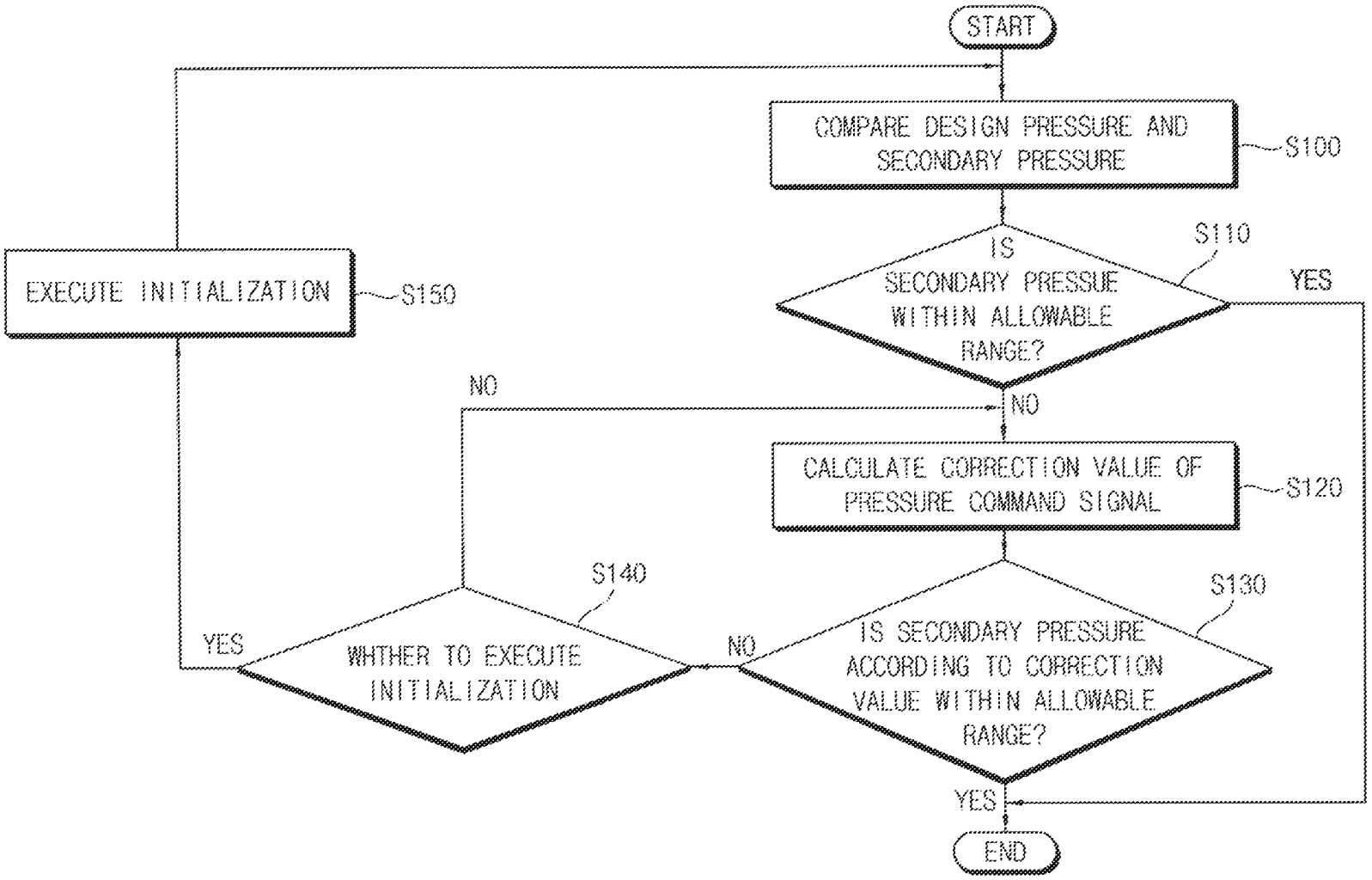
FIG. 4 is a flow chart illustrating an electro-hydraulic control method for construction machinery in accordance with example embodiments.

FIG. 4 is a flow chart illustrating an electro-hydraulic control method for construction machinery in accordance with example embodiments.

Referring to FIGS. 1, 2 and 4, a secondary pressure outputted from a spool displacement adjusting valve 400 may be received from a pressure sensor 410 according to an execution control signal of a correction program of the spool displacement adjusting valve 400, the detected secondary pressure may be compared with a design pressure (S100), whether a pressure difference between the detected secondary pressure and the design pressure is out of a preset allowable range may be determined (S110).

In example embodiments, an operator may determine whether to perform the correction program through a selection portion 700, for example, a correction process selection button on an instrument panel setting menu.

When the controller 500 receives the execution control signal of the correction program from the selection portion 700, the controller 500 may output an initial pressure command signal for a sampled design pressure (for example, 14 bar) to the spool displacement adjusting valve 400, and the spool displacement adjusting valve 400 may output a secondary pressure (pilot signal pressure) in response to the inputted pressure command signal. In here, the construction machinery may be controlled such that a bucket 10 has a posture in contact with the ground.

Then, the secondary pressure outputted from the spool displacement adjusting valve 400 and detected by the pressure sensor 410 may be compared with the sampled design pressure, and it may be determined whether the pressure difference is within the preset allowable range.

Then, when the pressure difference is out of the preset allowable range, a correction value of the pressure command signal may be calculated (S120).

In example embodiments, the controller 500 may correct the pressure command signal using a characteristic function of the pressure command signal of the spool displacement control valve 400 versus the design pressure. A correction value of the pressure command signal may be calculated by reflecting a difference value of the pressure command signal which converts the detected secondary pressure into the design pressure according to the characteristic function.

For example, a characteristic function in a section between the design pressure and the detected secondary pressure may be determined, and a new pressure command signal which converts the detected secondary pressure into the design pressure may be determined as the correction value of the pressure command signal using a linear interpolation method in the section.

Then, whether or not a secondary pressure outputted from the spool displacement adjusting valve 400 according to the correction value of the pressure command signal is within a preset allowable range may be determined (S130).

When the secondary pressure is within the preset allowable range, the correction program may terminate. In here, the correction value of the pressure command signal may be stored a new pressure command signal reference valve for the design pressure, and the controller 500 may output the newly stored correction value of the pressure command signal as a pressure command signal for the design pressure to the spool displacement adjusting valve 400.

When the secondary pressure is out of the preset allowable range, whether to execute initialization may be determined (S140).

When number of corrections performed according to the correction program is less than a preset number of times, the controller 500 may proceed to step S120 to calculate a correction value of the pressure command signal.

When the pressure difference is out of the preset allowable range even after performing the correction according to the correction program for the preset number of times or more, initialization may be executed (S150).

The controller 500 may output the initial pressure command signal stored as the initialization execution value to the spool displacement adjustment valve 400, and proceed to step S120 to correct the initial pressure command signal using an adjusted characteristic function of the spool displacement adjusting valve.

The present disclosure has been explained with reference to preferable embodiments, however, those skilled in the art may understand that the present disclosure may be modified or changed without being deviated from the concept and the scope of the present disclosure disclosed in the following claims.

THE DESCRIPTION OF THE REFERENCE NUMERALS

10: actuator
12: head chamber
14: rod chamber
100: hydraulic pump
110: pilot pump
200: hydraulic line
210: pilot line
212: head hydraulic line
214: rod hydraulic line
300: control valve
400: spool displacement adjusting valve
500: controller
510: data receiver
520: storage portion
530: comparison portion
540: output portion
600: manipulation portion
700: selection portion

The invention claimed is:

1. An electro-hydraulic control apparatus for construction machinery, comprising:

a control valve installed in a hydraulic line between a hydraulic pump and an actuator to control operations of the actuator according to a displacement amount of a spool therein;

a spool displacement adjusting valve configured to output a secondary pressure in proportion to an inputted pressure command signal to the spool of the control valve to control the displacement amount of the spool of the control valve;

a pressure sensor to detect the secondary pressure outputted from the spool displacement adjusting valve; and a controller configured to execute a correction program, wherein responsive to executing the correction program, the controller is configured to:

output an initial pre-stored pressure command signal for a sampled design pressure to the spool displacement adjusting valve; and correct the pre-stored pressure command signal when a pressure difference between a detected secondary pressure and the sampled design pressure predetermined by the initial pre-stored pressure command signal is out of a preset allowable range.

2. The electro-hydraulic control apparatus for construction machinery of claim 1, wherein when the pressure difference is out of the preset allowable range, the controller corrects the initial pre-stored pressure command signal using a characteristic function of the initial pre-stored pressure command signal of the spool displacement control valve versus the sampled design pressure.

3. The electro-hydraulic control apparatus for construction machinery of claim 2, wherein the controller calculates a correction value of the initial pre-stored pressure command signal by reflecting a difference value of the initial pre-stored pressure command signal which converts the detected secondary pressure into the sampled design pressure according to the characteristic function.

4. The electro-hydraulic control apparatus for construction machinery of claim 2, wherein the controller outputs a correction value of the initial pre-stored pressure command signal as a new pressure command signal to the spool displacement adjusting valve.

5. The electro-hydraulic control apparatus for construction machinery of claim 4, wherein a new secondary pressure outputted from the spool displacement adjusting valve according to the correction value of the initial pre-stored pressure command signal is detected, and when a pressure difference between the new secondary pressure and the sampled design pressure is out of the preset allowable range, the controller corrects the correction value of the pressure command difference using the characteristic function.

6. The electro-hydraulic control apparatus for construction machinery of claim 1, wherein the controller comprises a storage portion configured to store data of a characteristic function of the initial pre-stored pressure command signal of the spool displacement control valve versus the sampled design pressure;

a comparison portion configured to compare the detected secondary pressure and the sampled design pressure and correct the initial pre-stored pressure command signal using the characteristic function data; and an output portion configured to output a correction value of the initial pre-stored pressure command signal as a new pressure command signal to the spool displacement adjusting valve.

7. The electro-hydraulic control apparatus for construction machinery of claim 6, wherein the storage portion stores the correction value of the initial pre-stored pressure command signal as a new pressure command signal for the sampled design pressure.

8. The electro-hydraulic control apparatus for construction machinery of claim 1, wherein the spool displacement adjusting valve includes an electro proportional pressure reducing valve (EPPRV).

9. The electro-hydraulic control apparatus for construction machinery of claim 1, wherein the actuator is in contact with a ground while the controller is executing the correction program.

10. An electro-hydraulic control method for construction machinery, an electro-hydraulic control apparatus of the construction machinery including a control valve installed in a hydraulic line between a hydraulic pump and an actuator to control operations of the actuator according to a displacement amount of a spool therein, and a spool displacement adjusting valve configured to output a secondary pressure in proportion to an inputted pressure command signal to the spool of the control valve to control the displacement amount of the spool of the control valve, the electro-hydraulic control method, comprising:

executing a correction program;

responsive to executing the correction program, outputting an initial pre-stored pressure command signal for a sampled design pressure to the spool displacement adjusting valve;

detecting a first secondary pressure corresponding to the initial pre-stored pressure, outputted from the spool displacement adjusting valve;

correcting the initial pre-stored pressure command signal when a pressure difference between the detected first secondary pressure and a sampled design pressure predetermined by the pressure command signal is out of a preset allowable range; and storing a correction value of the initial pre-stored pressure command signal as a new pressure command signal for the sampled design pressure.

11. The electro-hydraulic control method for construction machinery of claim 10, wherein correcting the initial pre-stored pressure command signal comprises using a characteristic function of the initial pre-stored pressure command signal of the spool displacement control valve versus the sampled design pressure.

12. The electro-hydraulic control method for construction machinery of claim 11, wherein correcting the initial pre-stored pressure command signal comprises calculating the correction value of the initial pre-stored pressure command signal by reflecting a difference value of the initial pre-stored pressure command signal which converts the detected first secondary pressure into the sampled design pressure according to the characteristic function.

13. The electro-hydraulic control method for construction machinery of claim 11, further comprising:

detecting a new secondary pressure outputted from the spool displacement adjusting valve according to the correction value of the initial pre-stored pressure command signal; and correcting the correction value of the pressure command difference using the characteristic function when a pressure difference between the new secondary pressure and the sampled design pressure is out of the preset allowable range.

14. The electro-hydraulic control method for construction machinery of claim 10, further comprising:

outputting the correction value of the initial pre-stored pressure command signal as a new pressure command signal to the spool displacement adjusting valve.

15. The electro-hydraulic control method for construction machinery of claim 10, wherein the actuator is in contact with a ground while the controller is executing the correction program.

* * * * *